US005409278A

United States Patent [19]

Harcourt

[11] Patent Number: 5,409,278

[45] Date of Patent: Apr. 25, 1995

[54] HANDLE ASSEMBLY

[75] Inventor: Mervyn G. Harcourt, Brisbane, Australia

[73] Assignee: Whitco Pty Ltd., Australia

[21] Appl. No.: 81,379

[22] PCT Filed: Dec. 11, 1991

[86] PCT No.: PCT/AU91/00570

§ 371 Date: Jun. 29, 1993

§ 102(e) Date: Jun. 29, 1993

[87] PCT Pub. No.: WO92/12314

PCT Pub. Date: Jul. 23, 1992

[30] Foreign Application Priority Data

Jan. 11, 1991 [AU] Australia ..... PK4170

[51] Int. Cl.[6] ..... E05B 15/02

[52] U.S. Cl. ..... 292/357; 292/348; 403/349

[58] Field of Search ..... 292/357, 356, 352, 348, 292/DIG. 53, 351; 403/349, 343; 428/529

[56] References Cited

U.S. PATENT DOCUMENTS

| | | | |
|---|---|---|---|
| 1,497,842 | 6/1924 | Dollin | 292/348 X |
| 2,027,608 | 4/1934 | Moller | 292/357 |
| 2,357,102 | 8/1944 | Gold | 292/356 |
| 2,491,783 | 12/1949 | Thomas | 292/357 X |
| 2,536,494 | 1/1951 | Erkkila et al. | 292/357 |
| 2,728,597 | 12/1955 | Young | 292/347 |
| 2,778,667 | 1/1957 | Young et al. | 292/352 |
| 2,803,482 | 8/1957 | Zion | 292/347 |
| 2,810,600 | 10/1957 | Kendrick | 292/357 |
| 2,827,323 | 3/1958 | Kessel et al. | 292/352 |
| 3,136,572 | 6/1964 | Lytle | 292/357 X |
| 3,143,873 | 8/1964 | Hillgren | 292/352 X |
| 5,118,152 | 6/1992 | Lin | 292/357 X |

FOREIGN PATENT DOCUMENTS

| | | | |
|---|---|---|---|
| 215629 | 6/1957 | Australia . | |
| 65211 | 12/1946 | Denmark | 292/357 |
| 0417032A1 | 4/1990 | European Pat. Off. . | |
| 853067 | 11/1959 | United Kingdom . | |
| 2212549 | 7/1989 | United Kingdom . | |

*Primary Examiner*—Rodney M. Lindsey
*Attorney, Agent, or Firm*—Nixon & Vanderhye

[57] ABSTRACT

A handle assembly (5) is shown having a back plate (11) to which a knob (10) may be secured. A mounting plate (7) is fixed to the door (6). The plates (11, 7) have complementary fixing means (15, 16) to enable the plates to be secured to one another.

5 Claims, 3 Drawing Sheets

HANDLE ASSEMBLY

FIELD OF THE INVENTION

This invention relates to a door knob or handle assembly.

BACKGROUND OF THE INVENTION

Assemblies of the type to which the invention relates are commonly called locksets and are typically secured to internal doors of a building or the like. The lockset may include opposed knobs, handles or consist of a knob on one side of the door and a handle on the other. In one earlier proposal the knob-or handle was fixed to a plate or rose for rotation relative thereto and the handles were fixed to each other and to opposite sides of the door by a pair of screws which projected through the roses and through the door. Such a fixing arrangement was not aesthetically pleasing since the heads of the screws were visible externally of each of the roses. For cupboard doors a handle or knob on one side only was required.

In another earlier proposal a concealed fixing arrangement was employed. In that proposal the handles or knobs were fixed to respective roses for rotation thereto and a mounting plate was fixed to each side of the door by screws extending through the mounting plates and the door. The rose was then fixable to the mounting plate by screw threaded engagement therewith. It was typical for the mounting plate to be made of diecast or similar material and have an upstanding spigot with an external screw thread. The rose was provided with a spigot having a corresponding internal screw thread. The screw mounting was tedious to achieve and, if care was not taken cross threading could easily result and because of the nature of the materials involved this could lead to damage of the threads and render the lockset useless.

It is an object of the present invention to provide an improved door knob or handle assembly which at least minimises the disadvantages referred to above.

DISCLOSURE OF THE INVENTION

According to one aspect the invention provides a door knob or handle assembly for a door and having a rose or back plate to which a handle may be fitted and a mounting plate fixable to the door, said back plate and said mounting plate having complementary bayonet fixing means to enable said back plate to be fixed to said mounting plate.

The door knob or handle need not be rotatably mounted relative to the back plate. For example, where the knob or handle is simply intended to be fitted to a wardrobe or cupboard door or the like, rotation need not occur. Also, in such applications the assembly need not include the provision of a novel handle on each side of the door although, if the assembly is intended to be used as a typical lockset, then clearly a novel handle may be provided on each side of the door and each knob or handle would then be associated with a respective back plate and mounting plate as discussed above.

The knob or handle may be made from any suitable material or made from combinations of materials. For example, the knob may be made of porcelain, Wood or metal. Where a handle is present, the whole of the handle may be made from one material or alternatively several materials may be used to make up the handle. For example, the handle may have a user graspable portion made of wood or porcelain and that part of the handle secured to the back plate may be made of metal.

The bayonet fixing means may comprise outwardly extending projections on one of the back plate or mounting plate and receiving recesses or apertures on the other of the back plate and mounting plate.

Alternatively, projections and recesses or apertures may be present on both of the plates such that a projection on one plate may co-operate with a recess or aperture on the other plate.

It is preferred that the projections extend from the mounting plate and the recesses or apertures be provided on the back plate.

The projections may extend outwardly from the respective plate at spaced locations. Preferably the projections are regularly spaced and circumferentially around the plate. Although there may be a plurality of projections it is preferred that there be three. A greater number of projections may be present. The projections may consist of pins extending outwardly from the plate and having an enlarged head. As an alternative to the enlarged head the pins may simply be provided with a wasted portion spaced from the plate. As an alternative to pins, the projections may be provided by material displaced from the plate itself. For example, the projections may comprise portions pressed out of the plate. These pressed out portions may be formed with an area of enlarged widths for locking relative to a respective recess or aperture.

The recesses or apertures may be provided as slots in the plate. It is preferred that the slots have an enlarged width at one end thereof for receiving the enlarged width portion or head of the projection and a reduced width portion for retaining the projections once the two plates are rotated relative to one another to thereby lock the plates together. As mentioned, the recesses or apertures may be provided on the plate. In another alternative, an intermediate plate is fixed to the rear of the plate and the recesses or apertures are formed in that intermediate plate. The intermediate plate may be formed of resilient material to provide some measure of bias to hold the plates together when the bayonet fixing means are interengaged. The intermediate plate may be a spring plate made from mild steel or spring steel or the like. Alternatively, the intermediate plate may be made from plastics material.

DISCLOSURE OF THE DRAWINGS

A particular preferred embodiment of the invention will now be described by way of example with reference to the drawings in which.

DETAILED DESCRIPTION OF THE DRAWINGS

Figure 1:
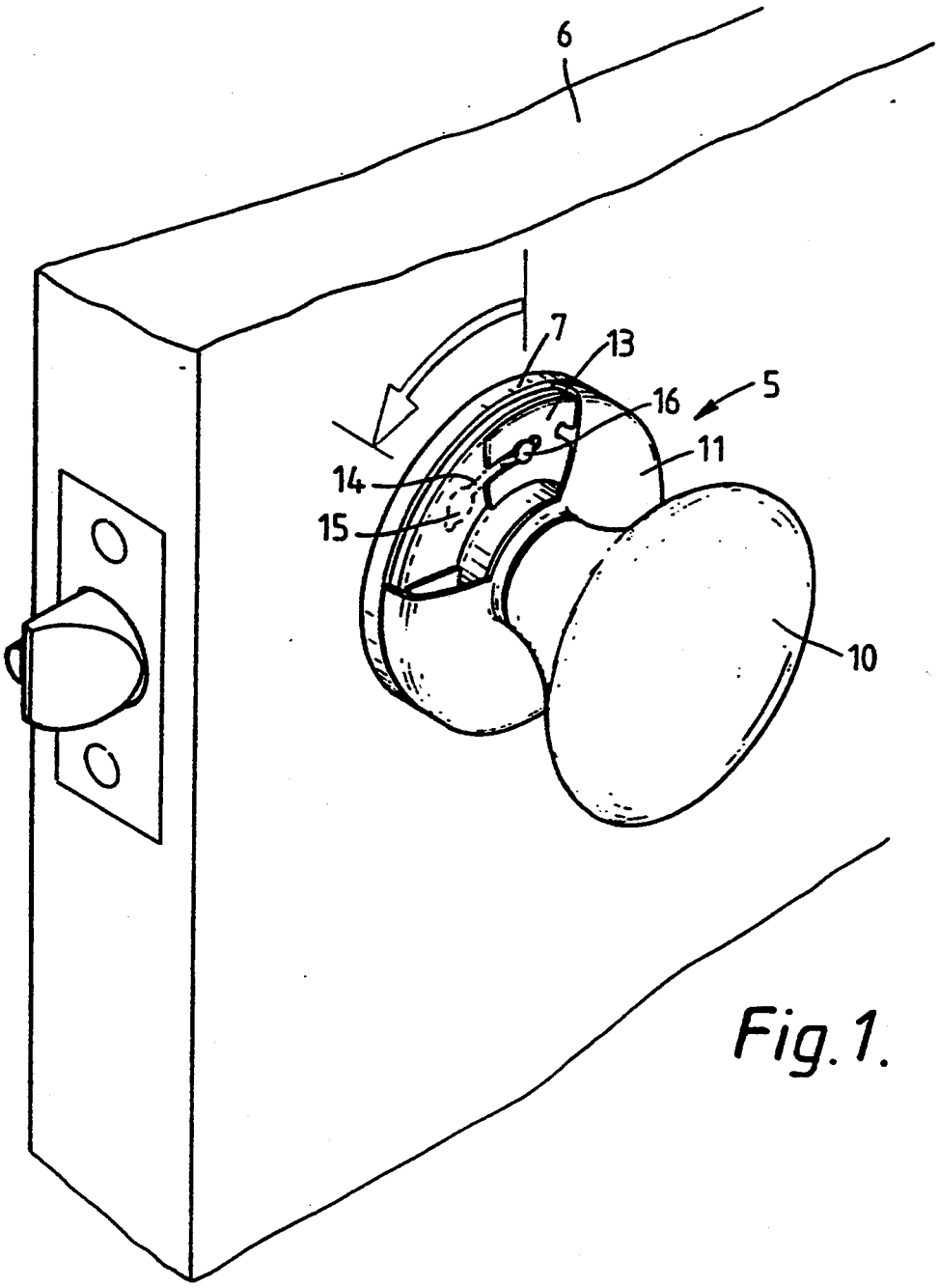
FIG. 1 is a broken away perspective view of an assembly according to an embodiment of the invention.

In FIG. 1 a door knob assembly 5 is shown fixed to a door 6. A similar assembly is fixed to that side of the door not visible in this figure. The assembly 5 has a mounting plate 7 fixed to the door by diametrically opposed screw fasteners 8, 9 (one of which is visible in each of FIGS. 2 and 3). Knob 10 is fixed to back plate or rose 11 and receives an end of an operating spindle 12 (shown in FIGS. 2 and 3). An intermediate plate 13 is fixed to the back plate 11 by rivets or the like (not shown). Intermediate plate 13 has circumferentially spaced key hole slots 14 with an enlargement 15 at one end.

The mounting plate 7 has projections 16 pressed from it which have a free end with a width greater than the reduced width portion of slots 14 but able to project through enlargements 15.

Figure 4:
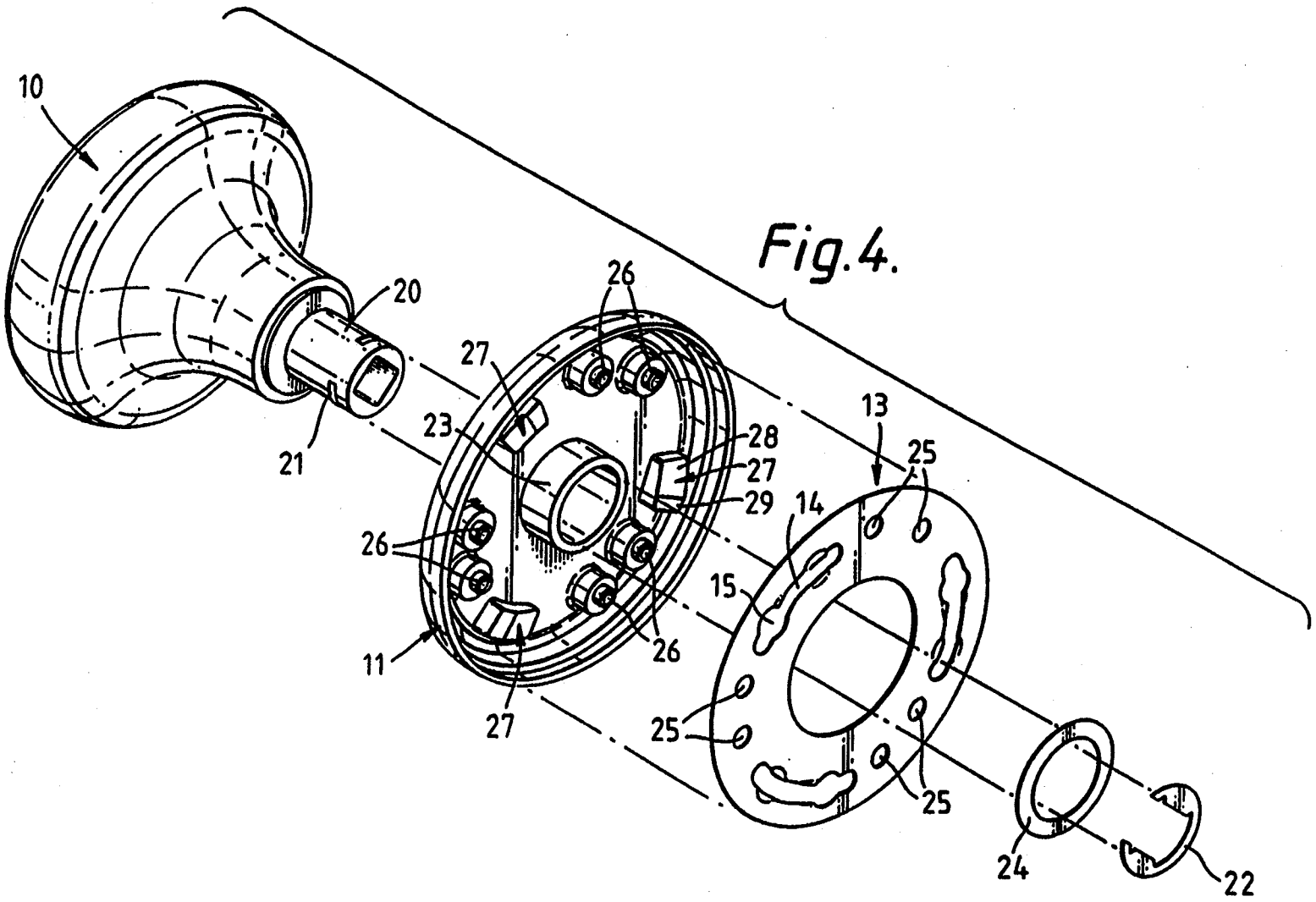
FIG. 4 is an exploded perspective view of part of the assembly according to an embodiment of the invention.

In FIG. 4 knob 10 is shown having a shaft 20 for receiving spindle 12 (not shown). The shaft 20 has groove 21 for receiving circlip 22. Back plate 11 has a spigot 23 through which shaft 20 may pass. Washer 24 is mounted onto the shaft 20 and circlip 22 then fixes the knob 10 relative to the spigot 23.

Intermediate plate 13 has three circumferentially spaced recesses or slots 14 with enlarged portions 15. Apertures 25 receive rivet posts 26. Posts 26 may be swaged to fix plate 13 to back plate 11.

Back plate 11 is provided with circumferentially spaced ramped abutments 27. Abutments engage the enlarged ends of projections 16 (see FIGS. 1 to 3) to ensure that the plate 11 is a tight fit relative to the mounting plate 7 (see FIGS. 1 to 3).

Each abutment 27 has a leading inclined portion 28 and a trailing portion which extends transversely of the assembly.

Figure 2:
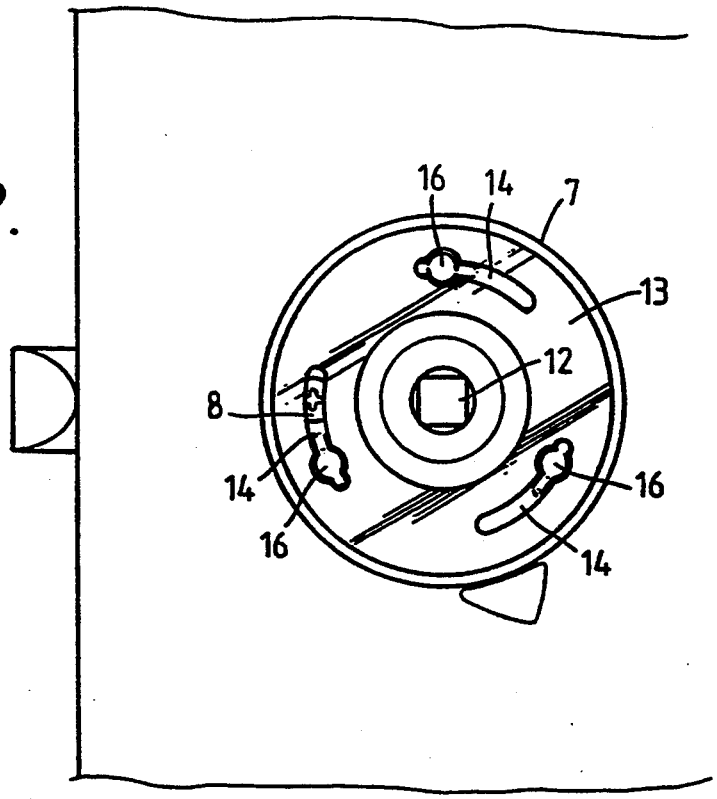
FIG. 2 is a front elevational view of the assembly of FIG. 1 with the bayonet fixing means engaged but not locked and with the knob and back plate removed for clarity.
Figure 3:
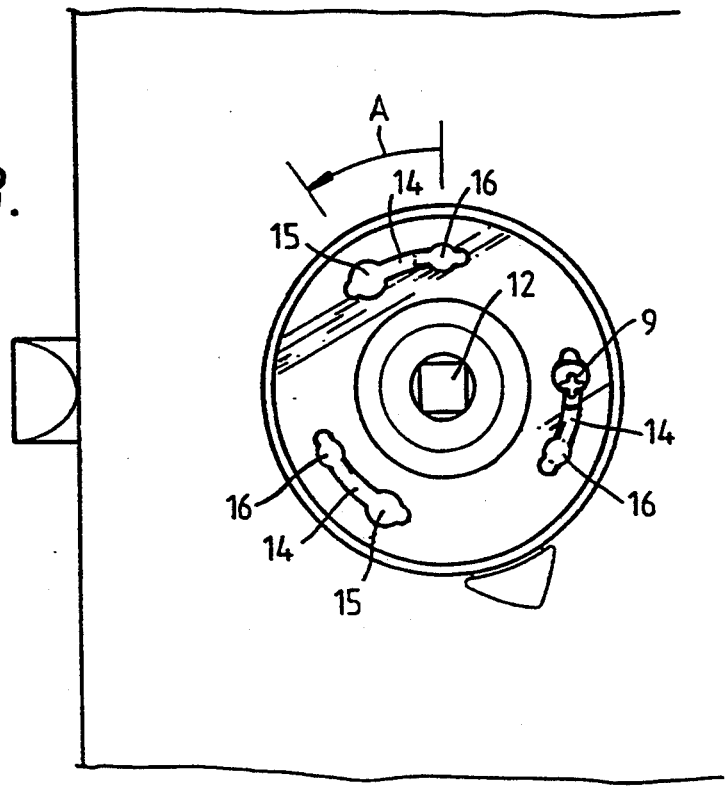
FIG. 3 is a front elevational view much like that of FIG. 2 but with the bayonet fixing means engaged and locked.

To fit a knob 10 to a door the mounting plate 7 is first secured to the door 6 and the back plate 11 with its intermediate plate is brought into engagement with the mounting plate as shown in FIG. 2. This enables projections 16 to locate in the enlargements 15. The back plate is locked in place by rotation in a direction along arrow A to cause the projections to move along the slots as shown in FIG. 3. In the FIG. 3 position the knob is in its use position and mounted in place.

Thus with the assembly of the invention quick fitting of the knob to the door is possible and the fitting is achieved in a concealed fashion without the need for screw mounting between the back plate and the mounting plate.

I claim:

1. A handle assembly for a door comprising a back plate for receiving a handle and a mounting plate fixable to a face of the door, the back plate including ramped projections and a resilient intermediate plate; complementary bayonet fixing means enabling the back plate to be fixed to the mounting plate, the bayonet fixing means including outwardly extending projections on one of the mounting plate or the back plate and closed circumferentially spaced arcuate slots on the other of the mounting plate or the back plate, the outwardly extending projections each having an enlarged head and each said slot having an enlarged width portion through which a respective said enlarged head may pass, the ramped projections biasing the outwardly extending projections of the bayonet fixing means against a periphery of a respective said arcuate slot.

2. The assembly of claim 1 wherein the handle is rotatably mounted to the back plate.

3. The assembly of claim 1 wherein the outwardly extending projections are provided on the mounting plate and the arcuate slots are provided on the intermediate plate.

4. The assembly of claim 1 including three said ramped projections, three said arcuate slots and three said outwardly extending projections.

5. The assembly of any one of claims 1 to 4 wherein the ramped projections have a leading inclined portion and a trailing transverse portion.

* * * * *